US008376215B2

(12) United States Patent
Thielges et al.

(10) Patent No.: US 8,376,215 B2
(45) Date of Patent: Feb. 19, 2013

(54) MULTIPLE PUNCH AND DIE ASSEMBLY

(75) Inventors: Bruce M. Thielges, Fridley, MN (US); Joseph C. Schneider, Elk River, MN (US)

(73) Assignee: Mate Precision Tooling, Inc., Anoka, MN (US)

( * ) Notice: Subject to any disclaimer, the term of this patent is extended or adjusted under 35 U.S.C. 154(b) by 129 days.

(21) Appl. No.: 12/758,081

(22) Filed: Apr. 12, 2010

(65) Prior Publication Data

US 2010/0212469 A1 Aug. 26, 2010

Related U.S. Application Data

(62) Division of application No. 11/583,430, filed on Oct. 19, 2006, now Pat. No. 7,726,554.

(51) Int. Cl.
*B26D 5/08* (2006.01)
*B26F 1/14* (2006.01)
*G06K 1/00* (2006.01)

(52) U.S. Cl. ..... 234/43; 234/44; 83/684; 83/552; 83/691

(58) Field of Classification Search ..... 83/552, 83/684, 691; 234/43–44
See application file for complete search history.

(56) References Cited

U.S. PATENT DOCUMENTS 3,527,130 A * 9/1970 Knehans ..... 83/454
3,985,056 A * 10/1976 Oseto ..... 83/552
4,096,774 A * 6/1978 Kaufmann ..... 83/552
4,765,264 A 8/1988 Bruton
5,020,407 A 6/1991 Brinlee
5,048,385 A 9/1991 Eckert et al.
5,062,337 A * 11/1991 Johnson et al. ..... 83/552
5,119,666 A 6/1992 Fujiwara
5,839,341 A 11/1998 Johnson et al.
5,848,563 A * 12/1998 Saito ..... 83/552
6,032,566 A 3/2000 Evans et al.
6,074,330 A 6/2000 Ostini
6,279,445 B1 * 8/2001 Rosene et al. ..... 83/698.91
6,675,688 B2 1/2004 Ostini
7,032,812 B2 * 4/2006 Ostini ..... 234/43
7,168,356 B2 1/2007 Rosene et al.
2008/0276783 A1 * 11/2008 Komiya ..... 83/691

OTHER PUBLICATIONS

MultiMatrix; Matrix SRL, Mar. 2005, MatrixSLR SCH10(VI) Italy.
Multi-Tool 10 Station MT 10 Folder EUROMAC SPA Sassuolo, Italy.
ADP-7 Folder Jul. 2001 Amada Amaraca Inc. Beuna Park, CA.
Strippit Multi-Tools Folder Apr. 2000 Strippit Inc. Akron, NY.
R-Series Multitool Folder Oct. 12, 2006 Wilson Tool, White Bear Lake, MN.

* cited by examiner

*Primary Examiner* — Ghassem Alie
*Assistant Examiner* — Bharat C Patel
(74) *Attorney, Agent, or Firm* — Nikolai & Mersereau, P.A.; James V. Harmon

(57) ABSTRACT

A multiple punch and multiple die assembly has a workpiece protector which is a punch lifter that is operatively associated with each punch for supporting each of the punches in an inactive position as an active punch is moved by the ram to the active, i.e. operating position to thereby eliminate scoring or marking of the sheet material or other workpiece that is being punched. To eliminate the need for hand tools and hand assembly or disassembly, a manually moveable retainer on the punch assembly is provided that can be moved by hand between a punch-releasing and punch-retaining position for holding the punches within the multi-punch assembly during operation. To prevent stress fractures that formerly occurred in die carriers, support of each die is distributed between two different die components thereby reducing impact stress on the carrier as the ram drives the punch through the workpiece.

5 Claims, 6 Drawing Sheets

MULTIPLE PUNCH AND DIE ASSEMBLY

CROSS-REFERENCE TO. RELATED APPLICATION

This application is a divisional of application Ser. No. 11/583,430, filed Oct. 19, 2006, and entitled "Multiple Punch and Die Assembly Providing Hand Disassembly, Punch Length Adjustment and Replacement". —

FIELD OF THE INVENTION

The present invention relates to the punch and die art and more particularly to a multiple punch and die assembly adapted for use in a punch press for punching or forming sheet material.

BACKGROUND OF THE INVENTION

In the punch and die art and particularly in the field of high-speed automated forming and punching equipment for punching and forming workpiece, e.g., sheet metal and especially in the case of automated turret punch presses, the punch presses are operated by computer to rapidly perform a series of punching or forming operations sequentially. These punch presses which by themselves form no part of the present invention are typically provided with aligned upper and lower turrets that rotate and are indexed intermittently between punching operations. The turrets may hold as many as a dozen or more separate punches that are used in sequence for performing given operations. A multiple punch or "multi-punch" has several punches in a single casing or assembly. When a punch is struck from above by the punch press ram, a single selected punch element or punch insert within the assembly is driven downwardly through the workpiece to perform the punching operation, while the other punches (those not selected) remain inactive. When released, the punch insert is retracted by a spring provided in the punch assembly.

Prior multi-punches exhibit certain shortcomings. Some are not suited for standard tooling used for single station punches since they required stations of special construction or special tooling that cannot be used in standard equipment such as the well-known "thick turret" style tooling. Another shortcoming is the time, effort, and inconvenience involved in disassembling a punch assembly because of the need for hand tools required to take them apart. Thus, in multi-punches now in use such as those shown, for example, in U.S. Pat. Nos. 6,675,688 and 7,032,812, the strikers, gears, and connected components all have to be removed with wrenches or other tools in order to remove, adjust, or replace punches or worn internal parts. In addition, vibration or impact shock will occasionally jar one or more of the unused punches causing it to be elevated enough above its normal resting position to strike the punch ram as punch assemblies are rapidly indexed from one position to another during operation. When this happens, it can, of course, severely damage the punch or other parts of the equipment. The Matrix company of Schio Italy makes a thick turret punch such as a ½" station punch with no center shaft, but occasionally one of the inactive punches can be jarred enough to bounce upwardly a fraction of an inch as the punches are rapidly switched between stations under the control of the punch press computer and when elevated in this way, the punch can accidentally strike the ram causing damage to the machine. Thus, there is no positive way of preventing damage from parts accidentally striking one another during operation. A still further disadvantage of prior multi-punches is the tendency for one or more of the unused punches to mark or otherwise score the top of the workpiece as the active punch is driven through the workpiece. Die carriers are also subject to stress cracking.

In view of these and other deficiencies of the prior art, it is one object of the present invention to provide an improved multi-punch and die assembly suited for wide application in a variety of presses using standard tooling including "thick turret" style tooling rather than being limited for use in a special tooling set-up.

Another object of the invention is to provide an improved multiple punch and die assembly that makes possible hand disassembly and punch length adjustment, i.e. servicing, adjustment, and punch replacement without the use of tools.

Another object of the invention is to prevent damage to inactive punches or associated equipment as the punch assembly is rapidly indexed between successive operating positions.

Yet another object of the invention is to prevent inactive punches from striking, scoring, or otherwise marking a workpiece as the active punch is driven through the workpiece.

Still another object of the invention is to reduce or eliminate stress on the die carrier due to repeated impact forces as the punches are driven through a die.

These and other more detailed and specific objects of the present invention will be better understood by reference to the following Figures and detailed description which illustrate by way of example but a few of the various forms of the invention within the scope of the appended claims.

SUMMARY OF THE INVENTION

The present invention provides an improved multi-punch and die assembly that is adapted to be placed for operation in a high speed, computer-controlled punch press having a punch ram for imparting movement to a selected punch that is held in a punch assembly for carrying out a punching or forming operation. The multi-punch assembly has a plurality of circumferentially arranged, selectively operable punches that are slideably mounted for independent movement within the multi-punch assembly so as to contact a workpiece when moved to an operating position by the punch ram. During operation, the punches are rapidly repositioned between strokes so as to be selectively struck by the ram whereby as one punch is driven to an operating position, at least one other punch remains inactive. In one aspect of the invention, a workpiece protector comprising a punch lifter is operatively associated with each punch for supporting each of the inactive punches in a raised position as an active punch is moved by the ram to the active, i.e. operating position to thereby eliminate scoring or marking of the sheet material or other workpiece that is being punched. A further aspect of the invention is the provision of a manually moveable retainer on the punch assembly that can be moved by hand between a punch-releasing and punch-retaining position for holding the punches within the multi-punch assembly during operation while allowing removal and adjustment of punches without hand tools. Another aspect of the invention is the prevention of stress fractures that formerly occurred in die carriers by distributing support for the dies between two different die components which contact the dies thereby reducing impact stress on the carrier as the ram drives the punch through the workpiece.

DESCRIPTION OF A PREFERRED EMBODIMENT

Figure 1:
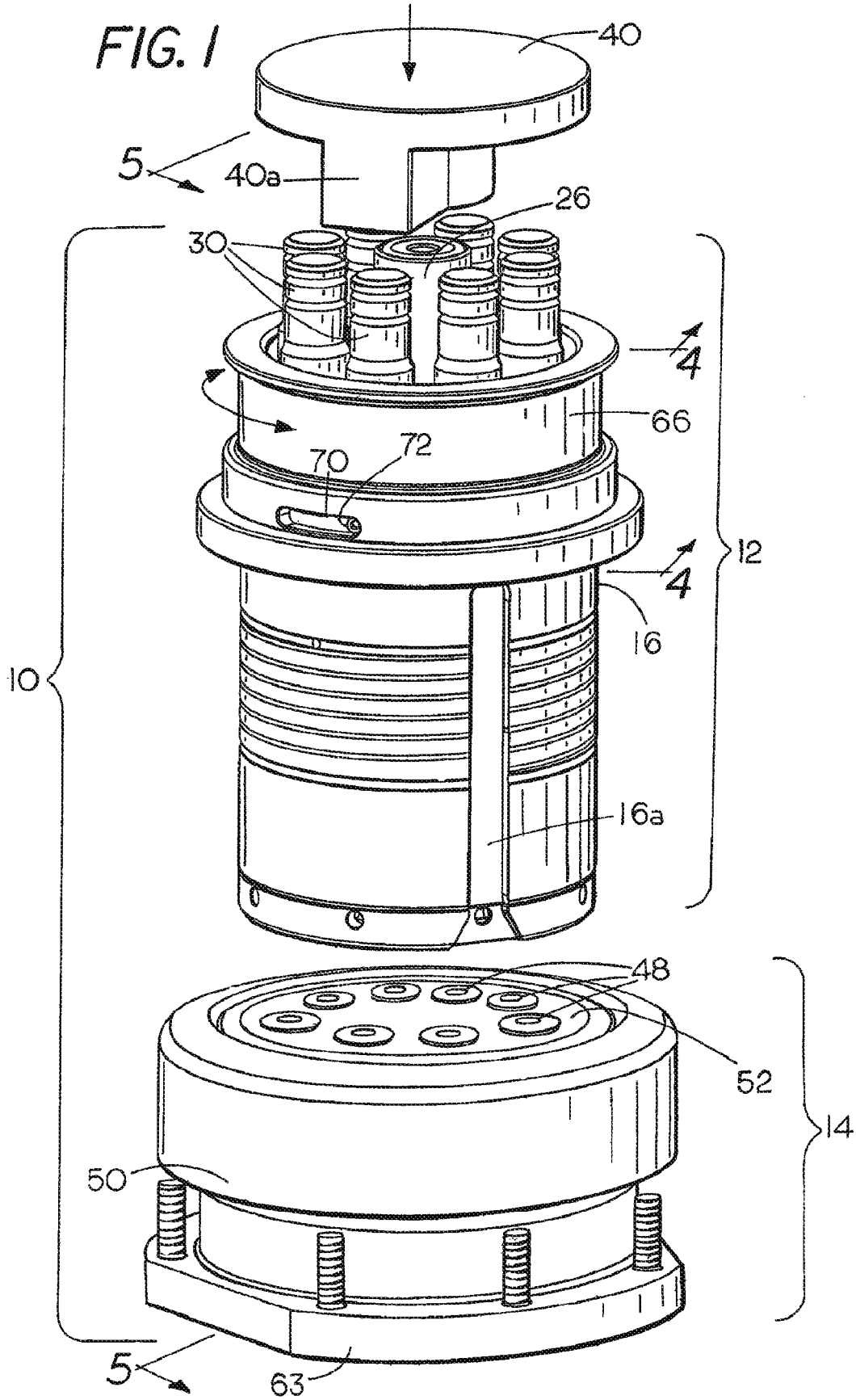
FIG. 1 is a perspective view of a punch and die assembly in accordance with the invention.
Figure 5:
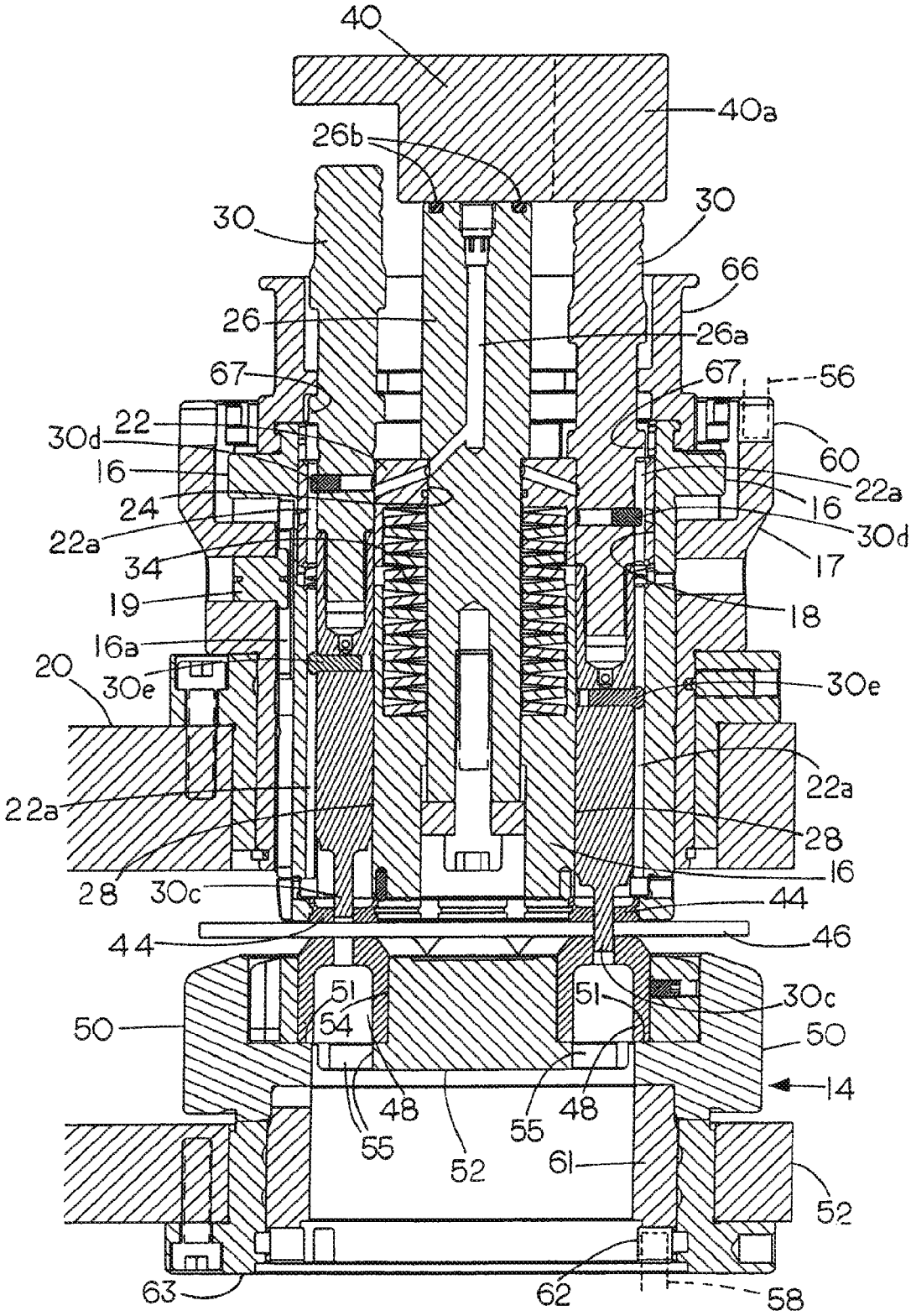
FIG. 5 is a vertical sectional view taken on line 5-5 of FIG. 1 on a somewhat enlarged scale showing the ram driving one of the punches to an operating position through the workpiece and into the die.
Figure 6:
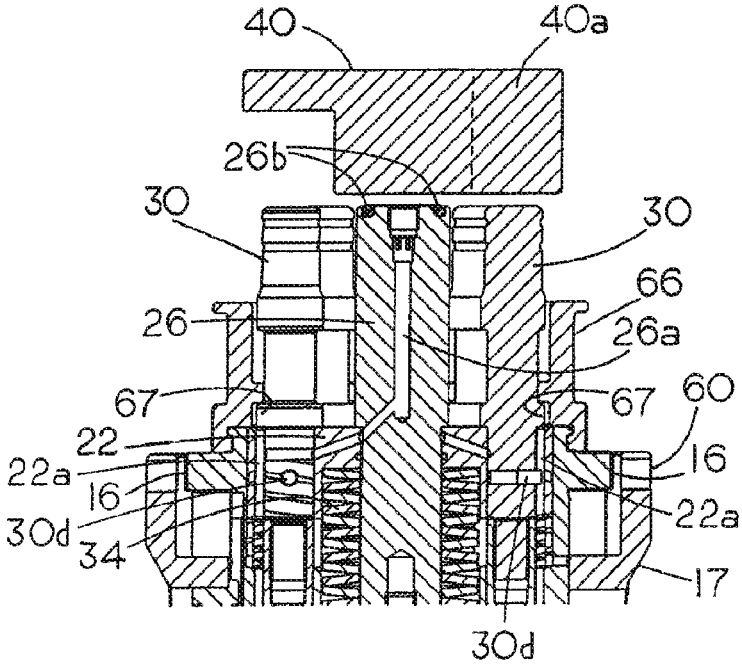
FIG. 6 is a partial sectional view similar to FIG. 5 on a slightly reduced scale showing the ram in its retracted position with all of the punches in their elevated resting positions.

As shown in FIG. 1, a punch and die assembly indicated generally by the numeral 10 includes a multiple punch assembly or multi-punch 12 and a multiple die assembly 14 that is aligned beneath the punch assembly 12 during operation. The punch assembly 12 includes an upper tool holder 16 supported within a housing 17 that is mounted on an upper punch press turret 20 during operation in a conventional manner with its lower end extending through an opening in the upper press turret 20 as shown. The punch press and its turrets per se form no part of the present invention. As seen in FIG. 1, the punch holder 16 is provided with a vertical slot 16*a* that is keyed to the housing 17 by means of a pin 19 (FIG. 5) to hold all of the punches 30 in a desired angular orientation about the central axis of the assembly. During operation, the housing 17 and multi-punch assembly 12 is rapidly rotated in a conventional manner about the vertical central axis between each operation of the ram 40 to carry out a predetermined punching sequence as will be described more fully below. Slideably mounted in a central vertical bore 18 of tool holder 16 is a punch carrier 22 having a central bore 24 for a center shaft 26, and in this case, eight circumferentially spaced vertical bores 28, each to accommodate a punch 30. The punch carrier 22 is yieldably biased in an upward direction by a centrally located spring 34 and eight circumferentially spaced apart vertically disposed helical springs 32 (FIG. 7) both of which are mounted between the tool holder 16 and the punch carrier 22. Overlying parts are broken away in FIG. 7 to show the upper end of one of the springs 32. Spring 34 is composed of a stack of annular spring elements, i.e. belleville springs (FIG. 5).

Figure 2:
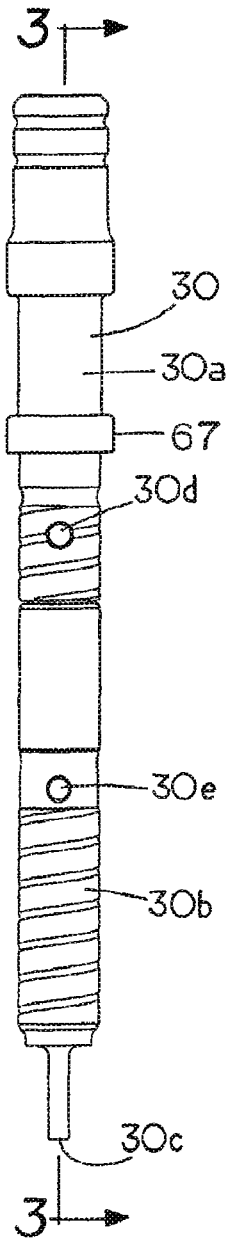
FIG. 2 is a side elevational view of one of the punches on a larger scale.
Figure 3:
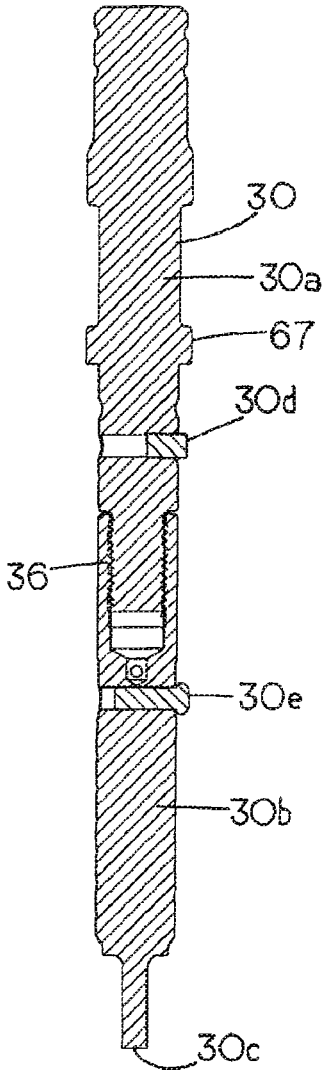
FIG. 3 is a vertical sectional view taken on line 3-3 of FIG. 2.

As can be seen with reference to FIGS. 2 and 3, each punch consists of two components, an upper driver component 30*a* with a key 30*d* and a lower punch head component 30*b* with a key 30*e*. The punch head is extendably connected to the upper component by a threaded connection 36 allowing the length of the punch 30 to be adjusted as required, especially for making length adjustments to accommodate for material that is removed from the punch tip 30*c* when the punch is sharpened.

To install a punch 30, the punch retainer 66 is rotated to the open position. The operator then aligns the punch driver key 30*d* with the punch head key 30*e* for installation. The punch is then slid into the proper station with the keys 30*d* and 30*e* in a selected key slot 22*a* as shown. The key 30*d* in the punch head slides through the key slot 22*a* in the punch carrier 22 and proceeds down through to an aligned key slot 22*a* in the tool holder 16 as the punch driver key slides into the punch carrier key slot.

The keys are aligned during initial assembly to ensure that the punch key goes into the slot in the tool holder 16 to prevent a punch from becoming hung up in the space between punch carrier and tool holder. That is the only time they need to be aligned. If desired, some of the stations can be used for round punches only. Those stations need only one slot in the tool holder 16, but the punch carrier 22 will have more key slots to allow the punch length adjustment to be refined.

Figure 9:
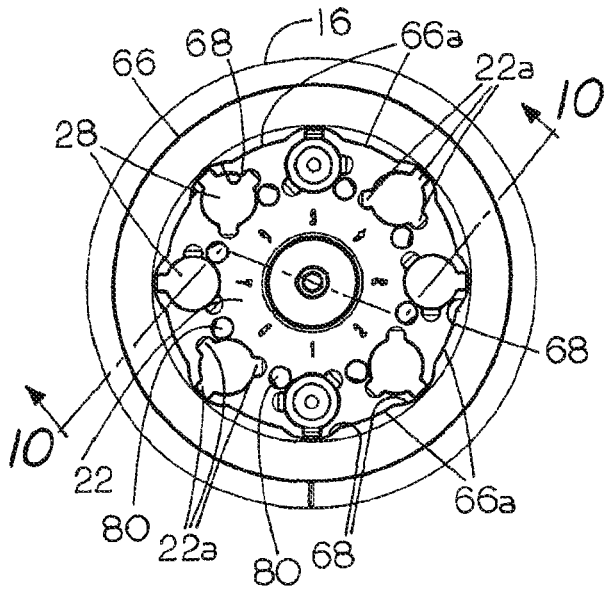
FIG. 9 is a top plan view of the punch assembly with the punches removed to show the punch guide slots.

To adjust the length of the punch, the operator rotates the punch retainer 66 (which will be describe in more detail below) to the open position and lifts the punch assembly 30 up until the punch driver key 30*d* is lifted out of the slot 22*a* in the punch carrier. The operator is then able to turn the punch driver 30*a* while the punch head remains stationary to allow adjustment in the punch length. The key 30*e* in the punch head needs to remain engaged with the slot 22*a* in the tool holder 16 but the key 30*d* in the punch driver 30*a* can now go in any of several parallel circumferentially space slots 22*a* (FIG. 9). This allows fine adjustment since it is not necessary to rotate one full revolution.

To entirely remove a punch assembly, the operator simply rotates the punch retainer 66 to the open position and pulls the punch assembly 12 straight out. There is no need to align any keys. As it is removed, each punch driver key 30*d* will come out of whichever slot 22*a* it is in and the punch head key 30*e* will come out of the slot 22*a* it is in and will come straight up through whichever slot it is aligned with in the punch carrier.

During operation, a punch press ram 40 having a radially extending lobe 40*a* is forcefully driven downwardly so as to strike the top surface of a selected one of the punches 30 (in this case the punch 30 at the right as seen in FIG. 5) so as to drive the center shaft 26 and punch 30 as well as the punch carrier 22 downwardly within the tool holder 16 against the spring force of the eight supporting springs 32 and the belleville spring 34. As the punch 30 shown at the right in FIG. 5 descends, the tip 30*c* at the lower free end passes downwardly through a stripper plate 44, then through workpiece 46 and finally through the die opening of a die 48.

As the punch press operates, the punch assembly 12 and the die assembly 14 are rotated about a vertical axis to selected positions and are maintained in continuous alignment about their common central axis by means of two position control fingers (FIG. 5) 56 and 58 which project into slots 60 and 62, respectively, in a conventional manner. The position control fingers 56 and 58 are rotated under the control of a computer as a part of the punch press (not shown) and per se form no part of the present invention so as to sequentially place various selected punches in succession beneath the lobe 40*a* of the punch ram 40 which reciprocates rapidly during operation but does not move laterally or turn about a vertical axis, thereby providing the desired pattern of punched openings that may be of different shapes and orientation (FIG. 11) in the workpiece 46.

Lubrication of the multi-punch assembly 12 is provided from an oiler (not shown) located in the ram 40 and fed through a lubrication duct 26*a* and other radially extending ducts to oil the punches 30. The top of the center shaft 26 is sealed around the duct 26 by a rubber O-ring 26*b*.

Figure 4:
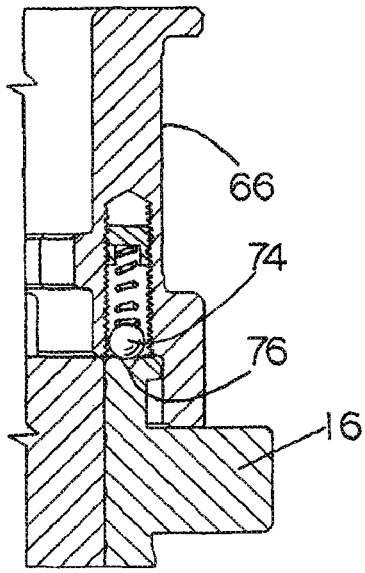
FIG. 4 is a partial vertical sectional view taken on line 4-4 of FIG. 1.
Figure 7:
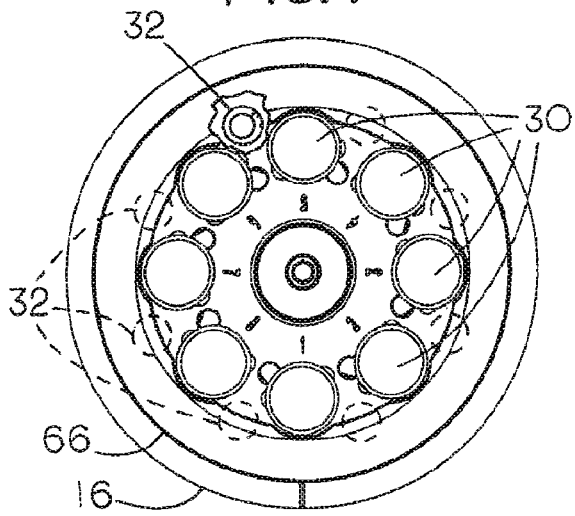
FIG. 7 is a top plan view partly broken away of the punch and die assembly with the punch retainer in an open position for allowing the punches to be removed manually.
Figure 8:
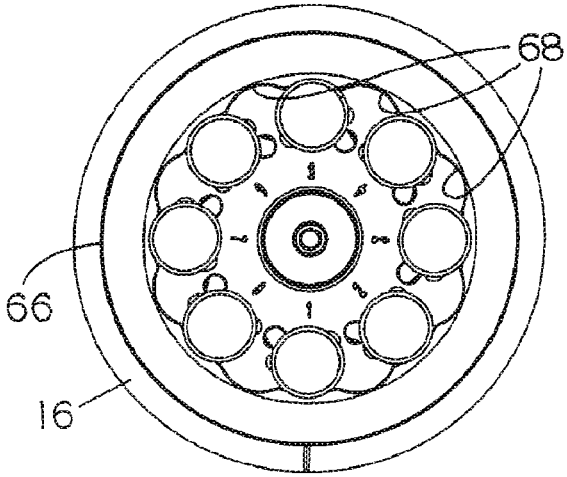
FIG. 8 is a view similar to FIG. 7 showing the punch retainer in a closed position for holding the punches within the punch assembly.

The punch retaining means will now be described in more detail with reference to FIGS. 1, 4, 5, and 7-9, which show a punch retainer comprising a punch-retaining collar 66 that is mounted on the upper end of the punch assembly 12 for manual rotation on the punch holder 16. To limit the angular rotation, a circumferential slot 70 is provided in the punch-retaining collar 66 (FIG. 1) with a screw head 72 extending out through the slot from tool holder 16 to limit rotational movement of the collar 66. The selected position of the punch retaining collar 66 is maintained as shown in FIG. 4 by a spring-loaded ball 74 which is forced into one of two pockets 76 when screw head 72 reaches each end of the slot 70 so as to place the collar 66 in either the punch retaining (closed) position as shown in FIG. 8 or in the punch releasing (open) position, as shown in FIG. 7. As can be seen best in FIGS. 7 and 9, the retaining collar 66 is provided with eight slots 68 between eight circumferentially spaced centrally projecting lugs 66*a* that when in the locked position engage the top of a boss 67 which extends radially from each punch 30, thereby limiting the upward movement of the punches so as to hold them within the punch assembly 12 during operation. To remove the punches 30 or to adjust length or angularity, change or sharpen them, no tools are required. Instead, the operator simply rotates the retaining collar 66 manually so as to align the slots 68 with the punches, thus enabling the punches to be removed by hand and without the use of tools. Because sharpening as well as the length adjustment can be accomplished without the use of tools, the care, adjustment, and replacement of the punches is greatly simplified and downtime is reduced. In addition, the retaining collar will prevent active punches from being jostled and in some cases jarred upwardly enough so that they can strike other parts of the machine as the punch and die assembly is rapidly moved from one position to another during a quick sequence of movements. It was found that the locking action of the retaining collar was effective in preventing damage to machine parts that occasionally occurred in the past when a punch was accidentally bounced into the path of the ram between strokes.

Figure 10:
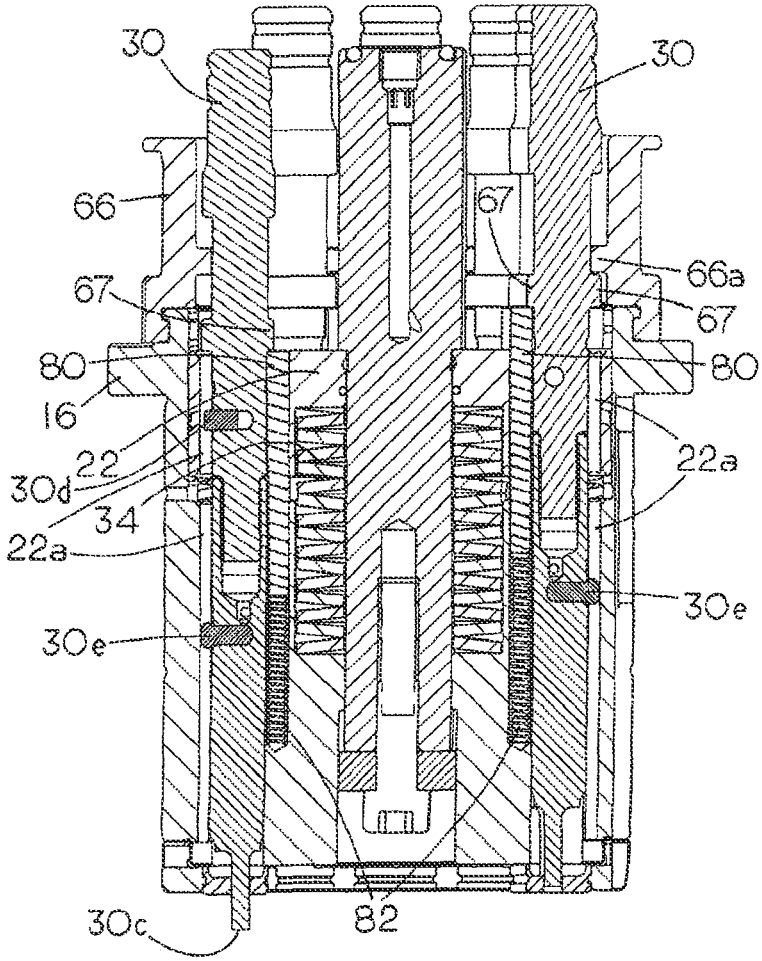
FIG. 10 is a vertical sectional view of the punch assembly taken on line 10-10 of FIG. 9.

Refer now especially to FIGS. 9 and 10 which illustrate a workpiece protector comprising a plurality of vertically disposed circumferentially distributed punch lifter pins 80 slideably mounted and yieldably biased in an upward direction by compression springs 82 within the vertical bore of the punch guide 16. When the punches 30 are inoperative, the punch lifter pins 80 elevate each of the inactive punches such as the one at the right in FIG. 10 about ½" above the surface of the punch carrier 22. However, when the ram strikes the top of one of the punches, the active punch and its punch lifter pin 80 are driven downwardly against the compression of one of the lifter springs 82 with the boss 67 remaining aligned with the top of the punch carrier 22. In this way, each punch lifter pin 80 and spring 82 supports one of the inactive punches against a retainer lug 66*a* as an active punch is moved to an operating position by the ram 40. Consequently, the lifters prevent marking or scoring of the sheet material workpiece 46 by the tip 30*c* of one of the inactive punches.

The multiple die assembly 14 and associated structure will now be described with particular reference to FIGS. 1, 5, 10, and 11. The multiple die assembly 14 includes a die holder 50 which is held during operation in a lower punch press turret 52*a* in alignment below the upper punch assembly 12. The die holder 50 is provided with a central bore which supports a die carrier 52 having, in this case, eight vertical, circumferentially spaced apart bores 54, each in this case with a radially projecting, vertically disposed alignment slot 56 for an alignment pin 58 that extends laterally from each of the dies 48. The position control arm 58, already described, is coupled to a sleeve 61 that is mounted for rotation in the lower turret 52*a* and in turn keyed to the die holder 14. The sleeve 61 is journaled in a bearing 63 that is bolted to the turret 52*a* as a part thereof.

Figure 11:
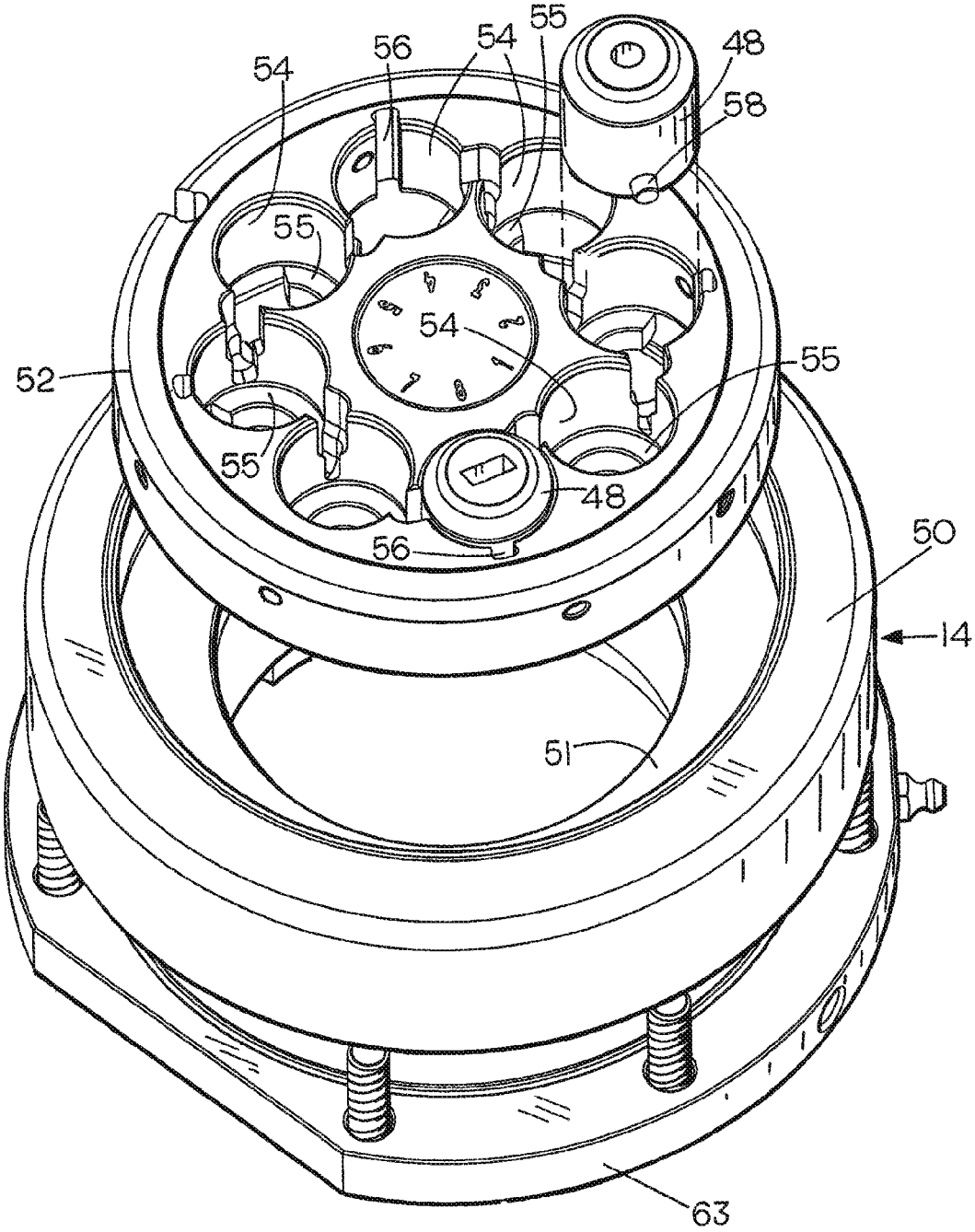
FIG. 11 is a top exploded perspective view of the die assembly on an enlarged scale showing one die in the operating position and a second die positioned for insertion into the die carrier.

The bore 54 for each of the dies 48 has a supporting lip 55 at its lower end that projects centrally and extends only part way around the bore (about 220°) leaving the center of each bore open beneath each die 48. As shown in FIGS. 5 and 11, the die holder 50 is provided with an upwardly facing shoulder 51 that is aligned with the top of the lip of 55 so that the support of the die 48 is distributed between the die carrier 52 and the die holder 50. It was found that this distribution of the die support reduces impact damage and possible stress cracking of the carrier 52 since the die holder 50 absorbs part of the impact.

Accordingly, the present invention permits the punch and die assembly to be taken apart by hand, that is to say without the use of hand tools thereby allowing the punches to be removed, adjusted, extended, and replaced if desired, all without the use of tools. In addition, the retaining collar 66 reliably keeps the punches in place so as to prevent them from being jarred or bounced upwardly far enough to strike the ram or any other part of the punch press during operation. The punch lifter pins 80 also cooperate with the lugs 66*a* of the retaining collar 66 to locate the punches while the punch lifter pins 80 prevent inactive punches from accidentally scoring, marking, or otherwise damaging the upper surface of the workpiece during operation. As the punch continues to move through the workpiece and die, the impact against the die will not damage the die carrier owing to the distribution of the die support between the die holder 50 and the die carrier 52.

To operate the invention, the multi-punch and die assembly 10 is first loaded into what is known as an "auto-index" station of a suitable commercially available punch press in which a computer controlling movement of the press from one station to another actuates the press ram and rotates the punch and die assembly by means of fingers 56 and 58 according to a predetermined sequence wherein each station carrying the selected punch assembly 12 and die assembly 14 is rotated under the striker ram 40. By means of an auto-index station control (not shown), the punch assembly 12 and die assembly 14 are then rotated on their common center axis to the appropriate multi-punch station that has been selected. The sheet metal workpiece is also indexed to its selected position conventionally. After the ram 40 is activated, the next punch and die assembly is then rotated to place a selected punch 30 beneath the lobe 40*a* of the ram.

Many variations of the present invention within the scope of the appended claims will be apparent to those skilled in the art once the principles described herein are understood.

What is claimed is:

1. A multiple punch and die assembly adapted to be placed in a punch press having a punch ram for imparting movement to the punch assembly for carrying out a punching or forming operation comprising, a punch assembly having a punch guide with a plurality of selectively operable punches mounted therein for independent axial reciprocating movement in the guide such that each punch thus selected engages a workpiece when in an operating position, a punch carrier for holding a plurality of the punches which are yieldably supported on the punch guide, the punches being positioned to be struck selectively by the ram such that one punch is driven through the punch guide to an operating position when at least one other punch is inactive, each of the punches having a resilient workpiece protector element for yieldably elevating each such punch above the punch carrier, each such workpiece protector element being operatively associated with a punch to thereby support each such inactive punch at an elevation preventing each inactive punch from making a workpiece during a punching operation, wherein each punch is operatively engaged by a resilient workpiece protector element so as to elevate each inactive punch above an operating position, and each inactive punch is thereby supported by a workpiece protector element located when each active punch moves toward an operating position as the ram drives the active punch through the punch guide; wherein each workpiece protector element comprises at least one compression spring connected between each such punch and a part of the punch guide located beneath a lower end of each workpiece compression spring, and wherein each workpiece protector element provides resilient support for one such punch while maintaining an upper end thereof suspended above an upper surface of the punch carrier.

2. The apparatus of claim 1 wherein each punch operatively engages a resilient workpiece protector element so that each punch is held above an operating position by supporting each punch that is in an inactive position, and each inactive punch is held by the resilient workpiece protector element to support an upper end of the punch above the punch carrier such that the path of the punch moving toward an operating position passes through the punch carrier as a ram drives the punch through the punch guide.

3. The apparatus of claim 1 wherein each punch is supported by a lifter pin member located between each resilient workpiece protector element and the punch.

4. The apparatus of claim 1 wherein each punch is supported by one of the resilient workpiece protector elements such that during operation each inactive punch is elevated sufficiently so as to not rest upon the punch carrier.

5. The apparatus of claim 1 wherein the punch carrier has a plurality of openings that each hold one of the punches and each opening is located below a boss on a punch that is elevated above the opening in the punch carrier by the resilient workpiece protector element.

* * * * *